US007931568B1

(12) United States Patent
Lin

(10) Patent No.: US 7,931,568 B1
(45) Date of Patent: Apr. 26, 2011

(54) SKI EXERCISING APPARATUS

(75) Inventor: William Lin, Taichung (TW)

(73) Assignee: Asia Regent Limited, Taichung (TW)

( * ) Notice: Subject to any disclaimer, the term of this patent is extended or adjusted under 35 U.S.C. 154(b) by 0 days.

(21) Appl. No.: 12/613,266

(22) Filed: Nov. 5, 2009

(51) Int. Cl.
*A63B 22/00* (2006.01)
*A63B 71/00* (2006.01)

(52) U.S. Cl. ..... 482/70; 482/71; 482/51

(58) Field of Classification Search ..... 482/51–53, 482/57, 70, 907, 71; 434/253
See application file for complete search history.

(56) References Cited

U.S. PATENT DOCUMENTS 4,402,506 A * 9/1983 Jones ..... 482/70
4,650,181 A * 3/1987 Yang ..... 482/73
4,663,704 A * 5/1987 Jones et al. ..... 700/83
5,833,584 A * 11/1998 Piaget et al. ..... 482/70
7,090,621 B2 * 8/2006 Loane ..... 482/71
2009/0105050 A1 * 4/2009 Mayo ..... 482/70

* cited by examiner

*Primary Examiner* — Steve R Crow
(74) *Attorney, Agent, or Firm* — Kilpatrick Townsend & Stockton LLP

(57) ABSTRACT

A ski exercising apparatus includes a ski unit including two ski members each having a wavy slide rail extending in a front-to-rear direction, two pedal units mounted slidably and respectively on the slide rails of the ski members, at least one pull rope mounted movably to the ski members and having two opposite ends connected respectively to the pedal units, two handle units connected pivotally and respectively to the ski members, and at least one connection unit disposed between and interconnecting the ski members and adjustable to change the position and orientation of one of the ski members relative to that of the other ski member.

10 Claims, 19 Drawing Sheets

SKI EXERCISING APPARATUS

BACKGROUND OF THE INVENTION

1. Field of the Invention

The invention relates to exercise equipment, more particularly to a ski exercising apparatus.

2. Description of the Related Art

Referring to FIG. 1, a conventional ski exercising apparatus 1 is shown to comprise a base 11, two pedals 12, and two handle units 13. The base 11 has two parallel slide rails 111 provided on a planar top face thereof. The pedals 12 are mounted slidably and respectively on the slide rails 111. The handle units 13 are connected pivotally to a front end of the base 11.

However, the conventional ski exercising apparatus 1 has the following drawbacks:

1. Regarding ski mountaineering activity training, since the slide rails 111 are provided on the planar top face of the base 11, movement of the pedals 12 along the slide rails 111 cannot simulate the uneven roads or paths found in natural settings, so that training of balance and reaction cannot be attained.

2. The slide rails 111 are provided fixedly on the base 11, so that training of the user's feet is fixed and monotonous. Since no variation in the slide rails 111 is possible, the user easily gets bored and loses interest in exercising.

FIG. 2 illustrates a conventional striding exerciser 8 which includes a support frame 81, two spaced-apart swingable legs 82 having top ends connected pivotally to the support frame 81, and two pedals 83 respectively fixed to bottom ends of the swingable legs 82. In use, the user steps on the respective pedals 83 and begins the exercise by moving the pedals 83 back and forth along fixed curved paths.

However, the conventional striding exerciser 8 has the following drawbacks:

1. Since the pedals 83 are designed to hang in the air, the user may easily fall from the pedals 83 and get injured. Hence, the conventional striding exerciser 8 is not safe to use.

2. Since the exercising paths of the pedals 83 are fixed and monotonous, the user easily gets bored and loses interest in exercising.

Referring to FIG. 3, another conventional ski exercising apparatus 9 is shown to comprise a base frame 91, an upright frame 92 extending upwardly from a front end of the base frame 91, two pedal units 93 mounted slidably on the base frame 91, and two handles 94 connected pivotally to the upright frame 92 and having bottom ends fixed respectively to front ends of the pedal units 93. Each pedal unit 93 has a pedal member 931, and a roller 932 provided on a rear end of the pedal member 931 and rollable on the base frame 91. A front end of the pedal member 931 extends upwardly and inclinedly, and is fixed to a bottom end of a respective handle 94.

The conventional ski exercising apparatus 9 has the following drawbacks:

1. Regardless of whether the user pedals forwardly or rearwardly, the toes of the user's feet are in an upward position. This position does not conform to ergonomics.

2. Since the pedal units 93 slide on the base frame 91 along a straight line during exercise, and since no variation in this regard is possible, the user similarly gets bored easily and loses interest in exercising.

3. Since each pedal unit 93 uses only a single roller 932 to move along the base frame 91, the conventional ski exercising apparatus 9 is unstable.

SUMMARY OF THE INVENTION

Therefore, the object of the present invention is to provide a ski exercising apparatus that can enhance efficiency of exercising, that is safe to use, and that increase interest in exercising.

According to this invention, a ski exercising apparatus comprises a ski unit including two ski members each having a wavy slide rail extending in a front-to-rear direction, two pedal units mounted slidably and respectively on the slide rails of the ski members, at least one pull rope mounted movably to the ski members and having two opposite ends connected respectively to the pedal units, two handle units connected pivotally and respectively to the ski members, and at least one connection unit disposed between and interconnecting the ski members and adjustable to change the position and orientation of one of the ski members relative to that of the other ski member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
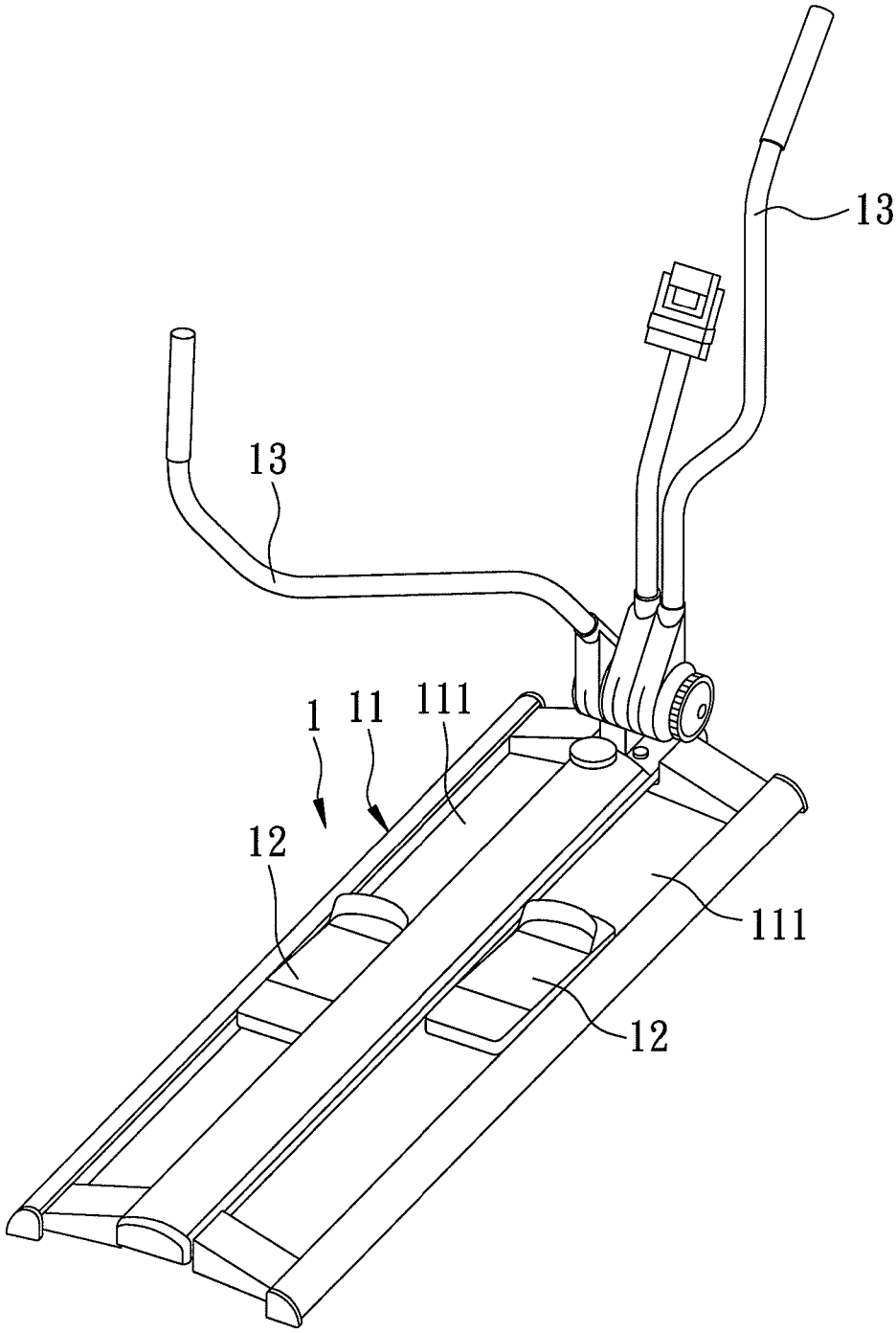
FIG. 1 PRIOR ART
FIG. 1 is a perspective view of a conventional ski exercising apparatus.
Figure 2:
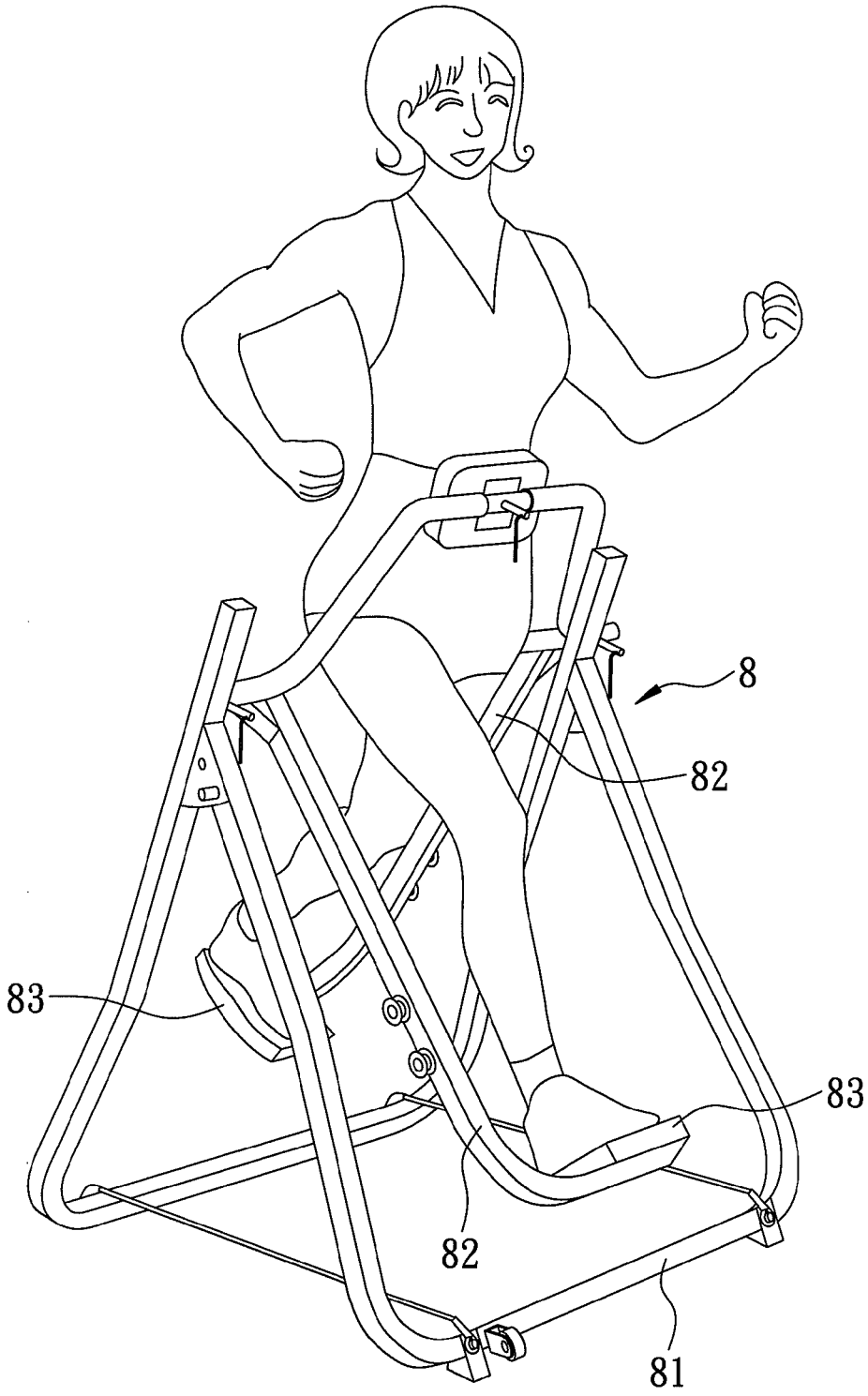
FIG. 2 PRIOR ART
FIG. 2 is a perspective view of a conventional striding exerciser.
Figure 3:
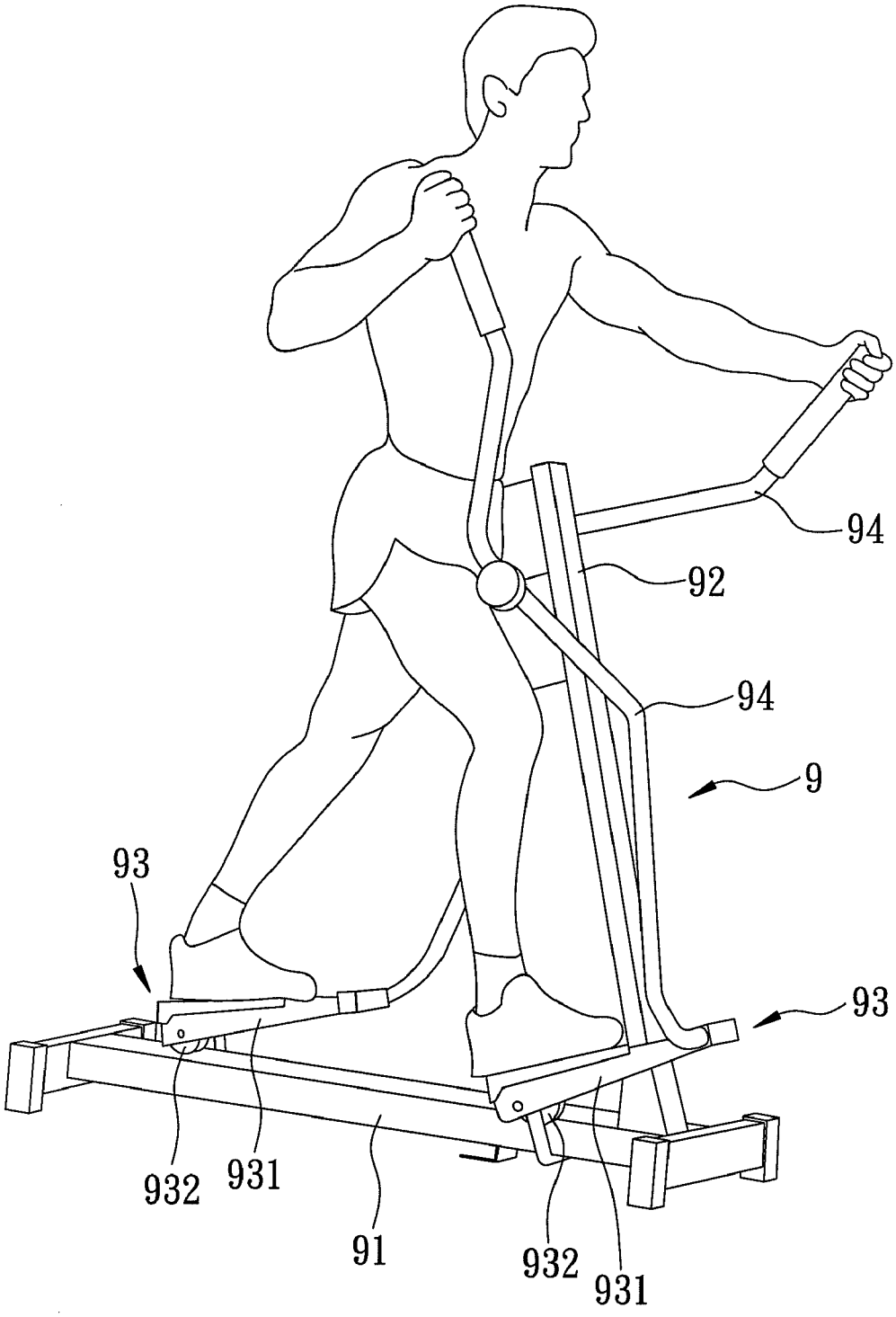
FIG. 3 PRIOR ART
FIG. 3 is a perspective view of another conventional ski exercising apparatus.

Referring to FIGS. 4 to 19, a ski exercising apparatus 100 according to the preferred embodiment of the present invention is shown to comprise a ski unit 3, two connection units 4, two pedal units 5, and two handle units 6.

The ski unit 3 includes two ski members 31 and four pairs of cushion pieces 32. Each ski member 31 has a wavy slide rail 311 formed on a wavy top face of a respective ski member 31 and extending in a front-to-rear direction, and front and rear receiving spaces 312, 312' (see FIG. 6). The wavy top face of each ski member 31 has front and rear end sections 313, 313', a raised section 314 between the front and rear end sections 313, 313', two concave sections 315 each disposed between one of the front and rear end sections 313, 313' and the raised section 314, and a wavy guide ridge 316 protruding therefrom. The raised section 314 has a height lower than that of the front and rear end sections 313, 313'. A maximum height (H) of each of the front and rear end sections 313, 313' measured from a lowest point of each concave section 315 ranges between 2 and 10 inches. The wavy guide ridge 316 extends in the front-to-rear direction, and has a central line 310 (see FIG. 11) extending along the length thereof. A distance (D) (see FIG. 11) between the central lines 310 of the guide ridges 316 of the ski members 31 ranges between 6 and 24 inches.

Figure 6:
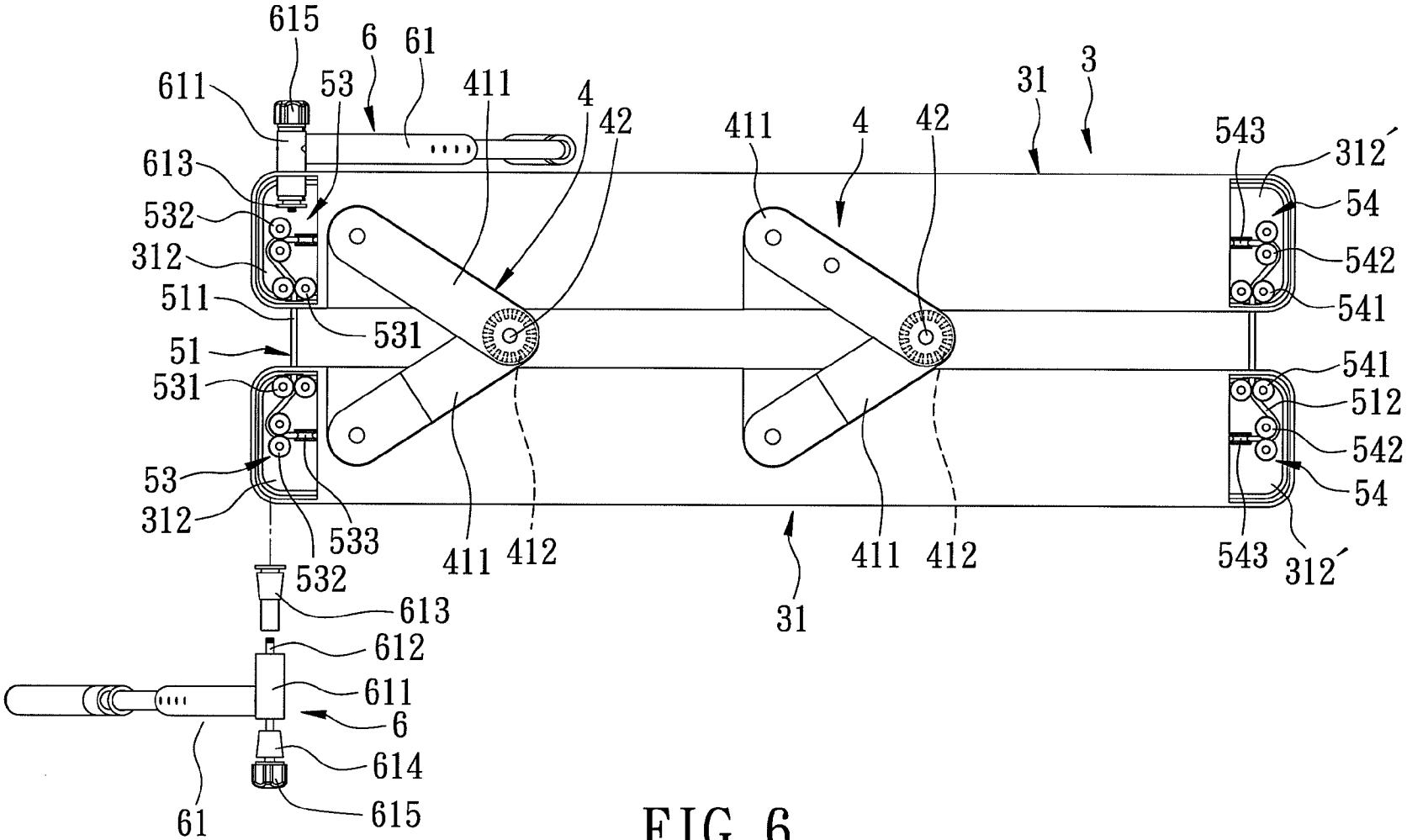
FIG. 6 is a schematic bottom view of the preferred embodiment.

The front and rear receiving spaces 312, 312' of each ski member 31, as shown in FIG. 6, are formed respectively in front and rear ends of a respective ski member 31. The slide rail 311 is disposed between the front and rear receiving spaces 312, 312'. Two pairs of the cushion pieces 32 are disposed respectively on the front end sections 313 of the ski members 31, while the other two pairs of the cushion pieces 32 are disposed respectively on the rear end sections 313' of the ski members 31. Each cushion piece 32 is made of a soft material.

Figure 10:
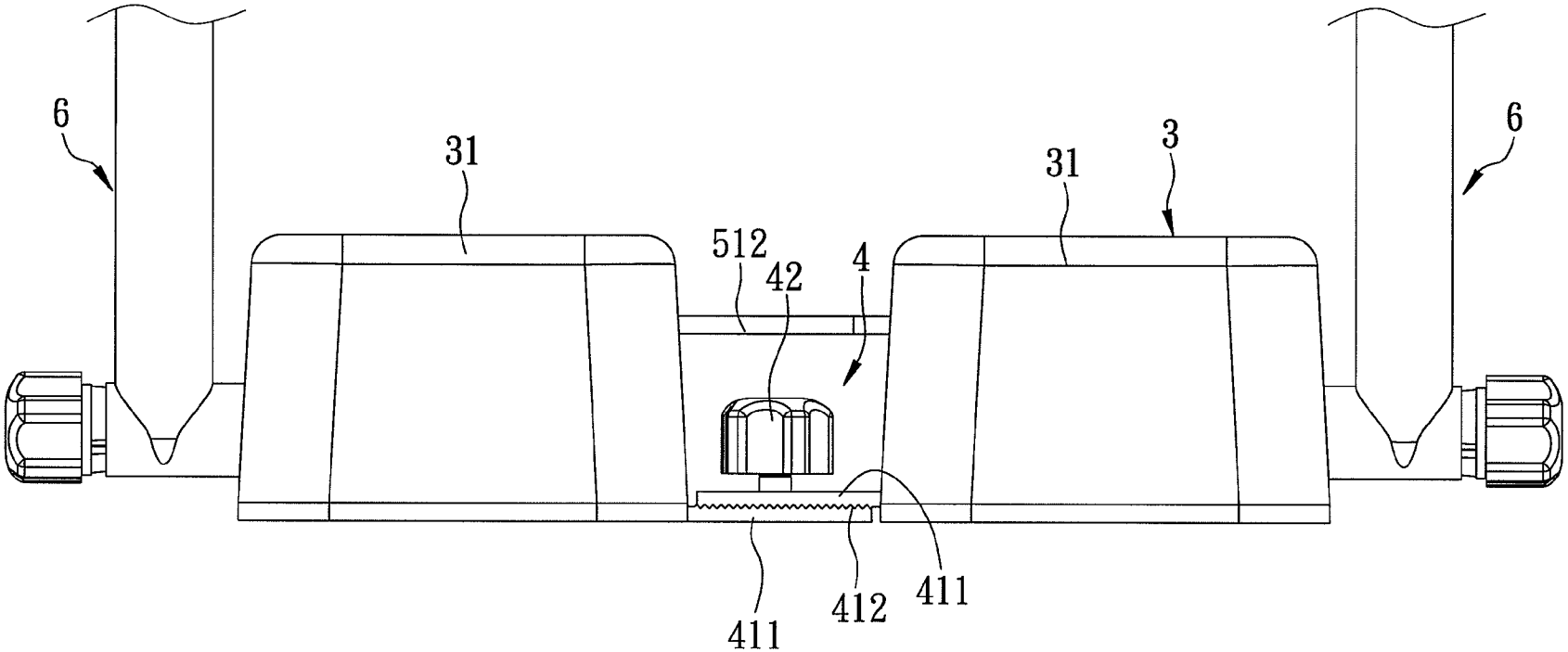
FIG. 10 is a view similar to FIG. 9, but illustrating the positioning screw in a tightened state.

Each connection unit 4 includes two pivot plates 411 and a positioning screw 42. Each pivot plate 411 has one end connected pivotally to a bottom end of the respective ski member 31. The other ends of the pivot plates 411 are fastened releasably to each other through the positioning screw 42, are disposed one over the other, and are each provided with a plurality of angularly spaced-apart radial teeth 412. The positioning screw 42 is operable to loosen and tighten the pivot plates 411. The radial teeth 412 of the pivot plates 411 are interlocked with each other when the positioning screw 42 is tightened, as best shown in FIG. 10, thereby preventing relative movement between the pivot plates 411.

Figure 7:
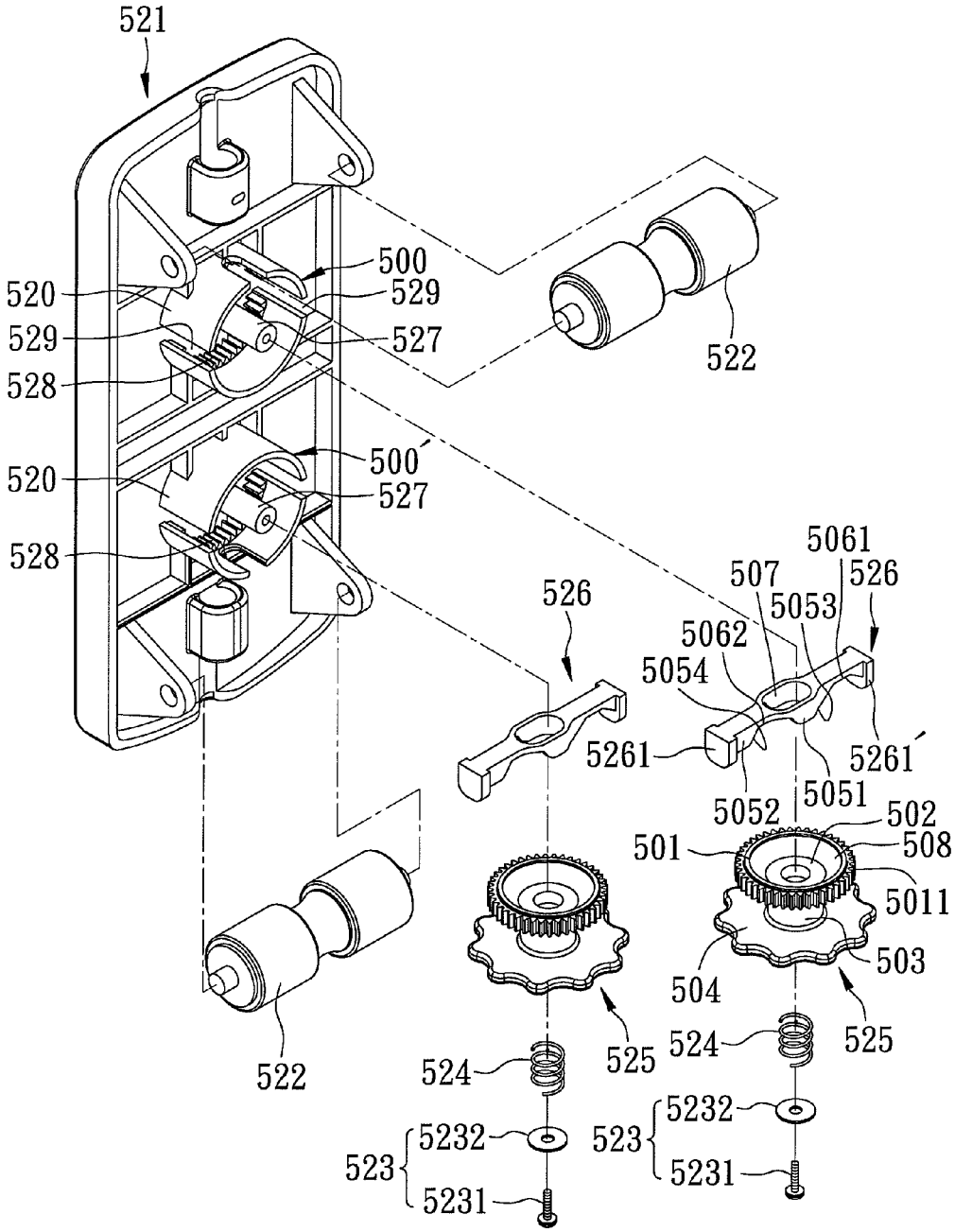
FIG. 7 is an exploded perspective view of a pedal unit of the preferred embodiment.

Each pedal unit 5 is mounted slidably on the slide rail 311 of the respective ski member 31, and, as shown in FIG. 7, includes a pedal plate 521, two rollers 522, and front and rear reel assemblies 500, 500'. The rollers 522 are mounted rotatably to a bottom side of the pedal plate 521, and are disposed respectively at front and rear ends of the pedal plate 521. The front and rear reel assemblies 500, 500' are connected to the bottom side of the pedal plate 521 between the rollers 522. Each of the front and rear reel assemblies 500, 500' includes a tubular reel casing 520 disposed beneath and connected to the bottom side of the pedal plate 521 and having an inner surface provided with an internal gear teeth portion 528, a spindle 527 projecting downwardly from the bottom side of the pedal plate 521 within the reel casing 520, two diametrically opposed cutouts 529 extending along the length of the reel casing 520, a reel member 525 sleeved rotatably on the spindle 527, and a push member 526 disposed transversely in the reel casing 520 between the bottom face of the pedal plate 521 and the reel member 525.

Figure 18:
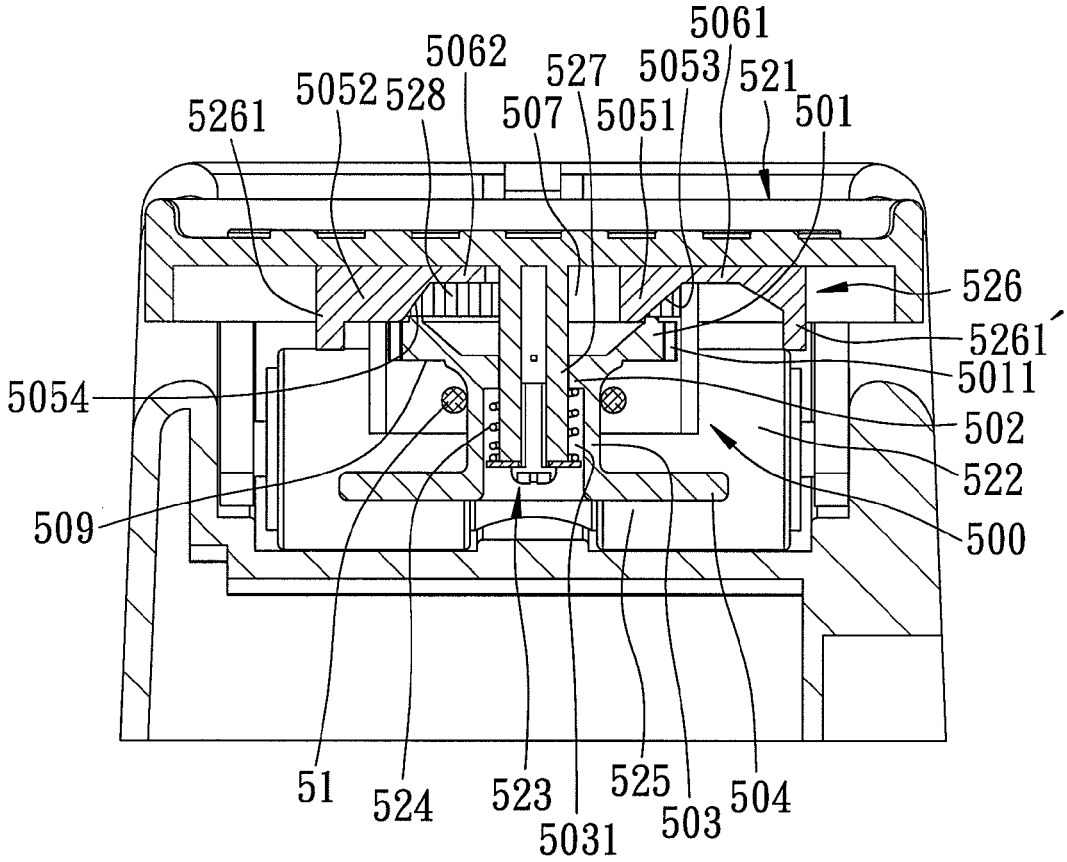
FIG. 18 is a sectional view of the pedal unit in an assembled state, illustrating how an external gear teeth portion of a reel member is pushed away from an internal gear teeth portion of a reel casing.
Figure 19:
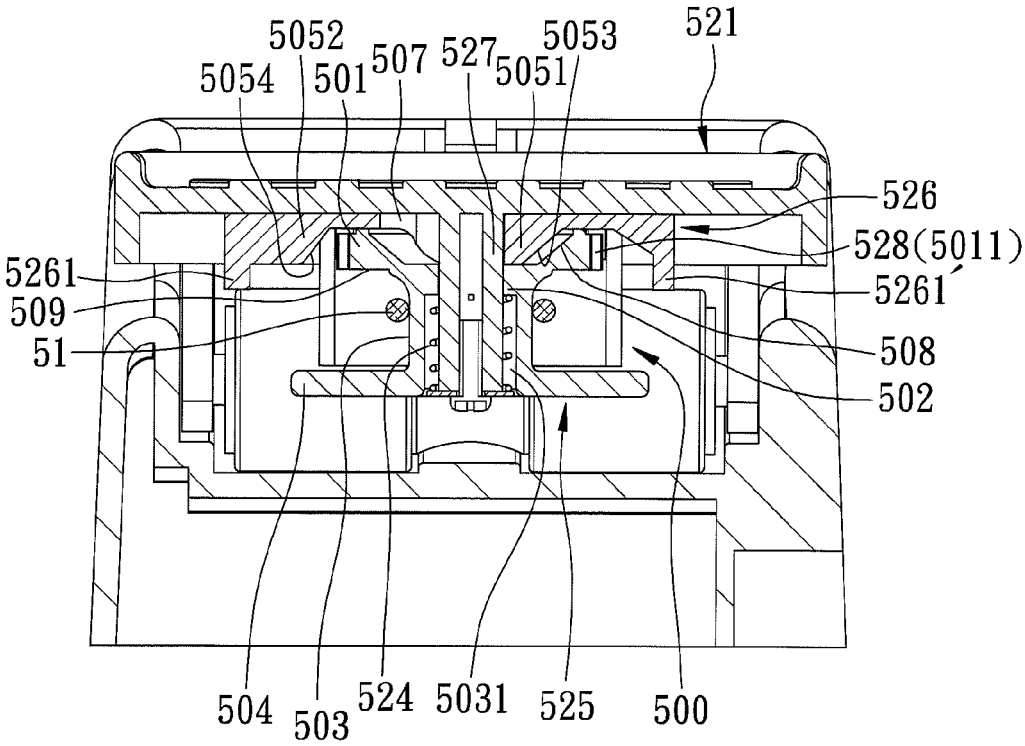
FIG. 19 is a view similar to FIG. 18, but illustrating the external gear teeth portion of the reel member meshing with the internal gear teeth portion of the reel casing.

With additional reference to FIGS. 18 and 19, the reel member 525 includes a spool shaft 503, an annular abutment portion 502 formed on a top end of the spool shaft 503, an annular flange portion 509 extending radially and outwardly from an outer periphery of the abutment portion 502, a ring portion 501 extending upwardly from an outer periphery of the flange portion 509, and a knob 504 extending outwardly and radially from a bottom end of the spool shaft 503. The ring portion 501 has an outer surface formed with an annularly arranged external gear teeth portion 5011 that is engageable with the internal gear teeth portion 528, and an inner conical surface 508 extending upwardly and divergingly from the abutment portion 502. In this embodiment, the spool shaft 503 has an annular space 5031 around the spindle 527 and proximate to the knob 504. The reel member 525 further includes a spring element 524 sleeved on the spindle 527 within the annular space 5031 and biasing the reel member 525 toward the push member 526, and a retaining element 523. The retaining element 523 includes a washer 5232 disposed on a bottom end of the spindle 527, and a screw 5231 connected to the spindle 527 so as to fix the washer 5232 to the bottom end of the spindle 527 and retain the reel member 525 on the spindle 527. The spring element 524 has two opposite ends abutting respectively against the washer 5232 and the abutment portion 502.

In this embodiment, the push member 526 is sleeved movably on the spindle 527 via an elongated hole 507, and has first and second opposite ends 5261, 5261' extending respectively through the cutouts 529 and disposed outwardly of the reel casing 520, a first push protrusion 5051 between the first and second ends 5261, 5261' and extending downwardly into the inner conical surface 508 and abutting against the abutment portion 502, a second push protrusion 5052 disposed in proximity to the first end 5261 and having an inclined surface 5054, a first indentation 5061 between the first push protrusion 5051 and the second end 5261', and a second indentation 5062 between the first and second push protrusions 5051, 5052. The first push protrusion 5051 also has an inclined surface 5053.

The rollers 522 of each pedal unit 5 are rollable on the wavy top surface of the respective ski member 31 along the wavy guide ridge 316 thereof, and bring therealong the pedal plate 521 to slide on the slide rail 311 of the respective ski member 31.

Each ski member 31 further has front and rear roller assemblies 53, 54 disposed respectively in the front and rear receiving spaces 312, 312', as best shown in FIG. 6. Each of the front and rear roller assemblies 53, 54 has a pair of side horizontal rollers 531, 541, a pair of central horizontal rollers 532, 542, and a pair of vertical rollers 533, 543. The side horizontal rollers 531 of the front roller assemblies 53 of the ski members 31 are disposed between the central horizontal rollers 532 thereof. The side horizontal rollers 541 of the rear roller assemblies 54 of the ski members 31 are disposed between the central horizontal rollers 542 thereof.

A rope assembly 51 includes front and rear pull ropes 511, 512 both made of non-elastic materials. The front pull rope 511 is mounted movably to the ski members 31, and has one end connected to the spool shaft 503 of the reel member 525 of the front reel assembly 500 of one of the pedal units 5, and the other end passing through the pair of the vertical rollers 533 and the pairs of the central and side horizontal rollers 532, 531 of the front roller assembly 53 of one of the ski members 31, through the pairs of the side and central horizontal rollers 531, 532 and the pair of the vertical rollers 533 of the front roller assembly 53 of the other ski member 31, and connected to the spool shaft 503 of the reel member 525 of the front reel assembly 500 of the other pedal unit 5. The rear pull rope 512 is connected to the pedal units 5 in a manner similar to that described for the two opposite ends of the front pull rope 511. Particularly, the two opposite ends of the rear pull rope 512 are connected respectively to the spool shafts 503 of the reel members 521 of the rear reel assemblies 500' of the pedal units 5.

Figure 4:
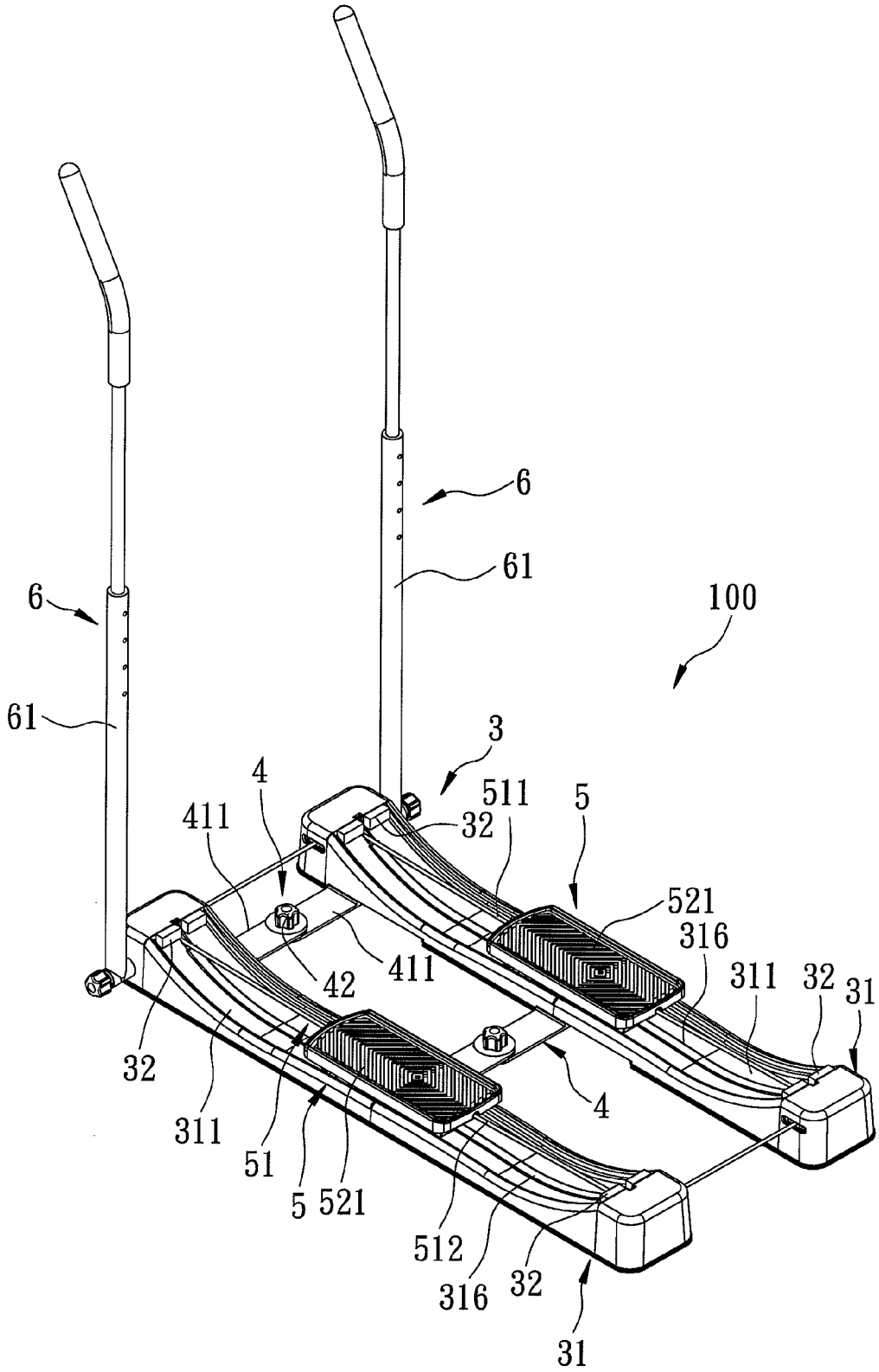
FIG. 4 is a perspective view of a ski exercising apparatus according to the preferred embodiment of the present invention.
Figure 5:
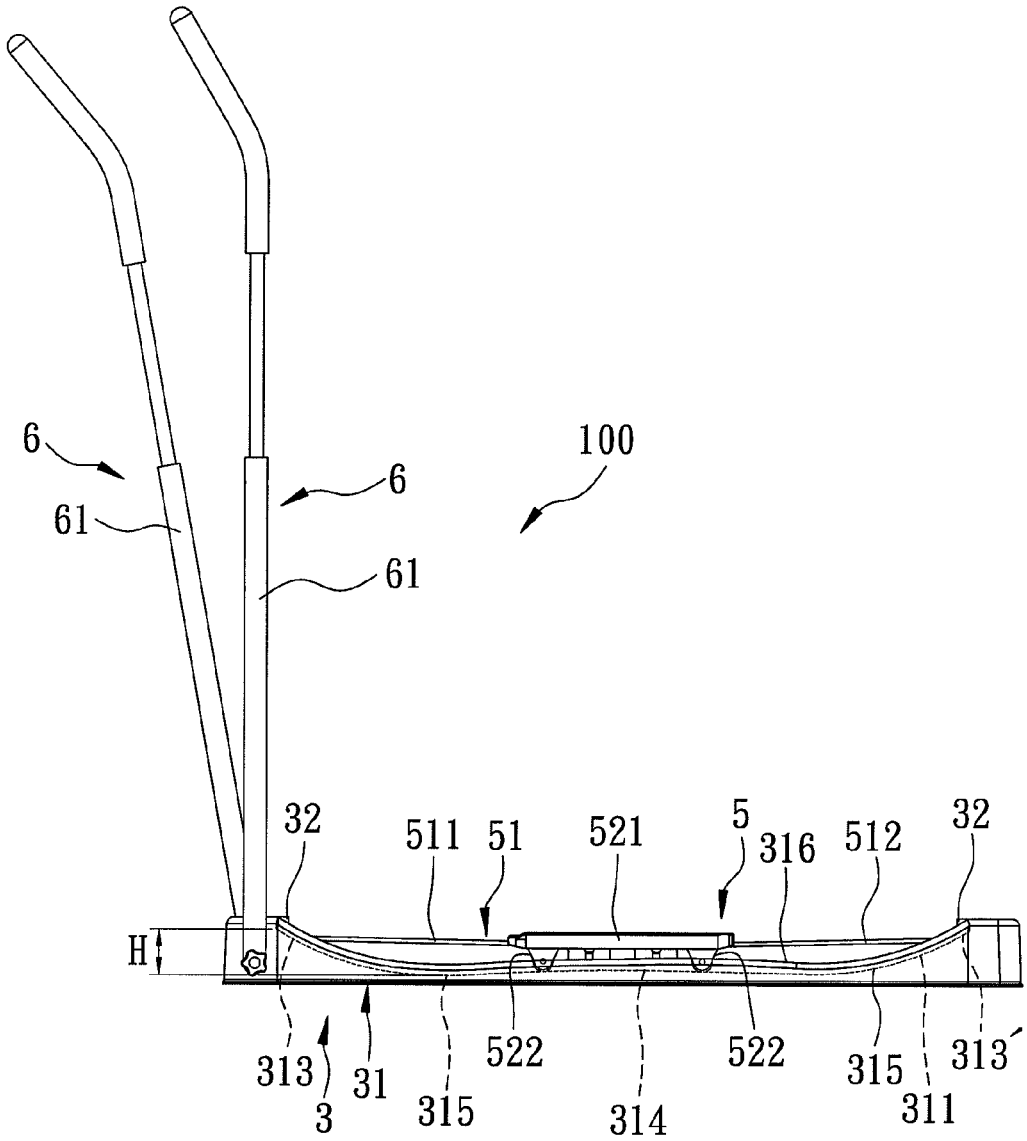
FIG. 5 is a schematic side view of the preferred embodiment.

The handle units 6, as shown in FIG. 4, are connected pivotally and respectively to a left front end of a left ski member 31 and a right front end of a right ski member 31. The front roller assemblies 53 of the ski members 31 and the front pull rope 511 are disposed proximate to the handle units 6, while the rear roller assemblies 54 of the ski members 31 and the rear pull rope 512 are disposed distal from the handle units 6. Each handle unit 6 includes a tubular sleeve 611 connected to the left or right front end of the respective ski member 31, an adjustable threaded rod 612 inserted rotatably through the tubular sleeve 611, a friction nut 613 connected threadedly to one end of the threaded rod 612 and disposed in the tubular sleeve 611, a bushing 614 sleeved on the threaded rod 612 and disposed in the tubular sleeve 611 opposite to the friction nut 613, a rotatable knob 615 formed on the other end of the threaded rod 612 adjacent to the bushing 614, and a handgrip 61 extending upwardly from an outer surface of the tubular sleeve 611. The bushing 614 and the friction nut 613 contact frictionally an inner surface of the tubular sleeve 611. The rotatable knob 615 and the threaded rod 612 may be replaced by a wing screw.

Figure 8:
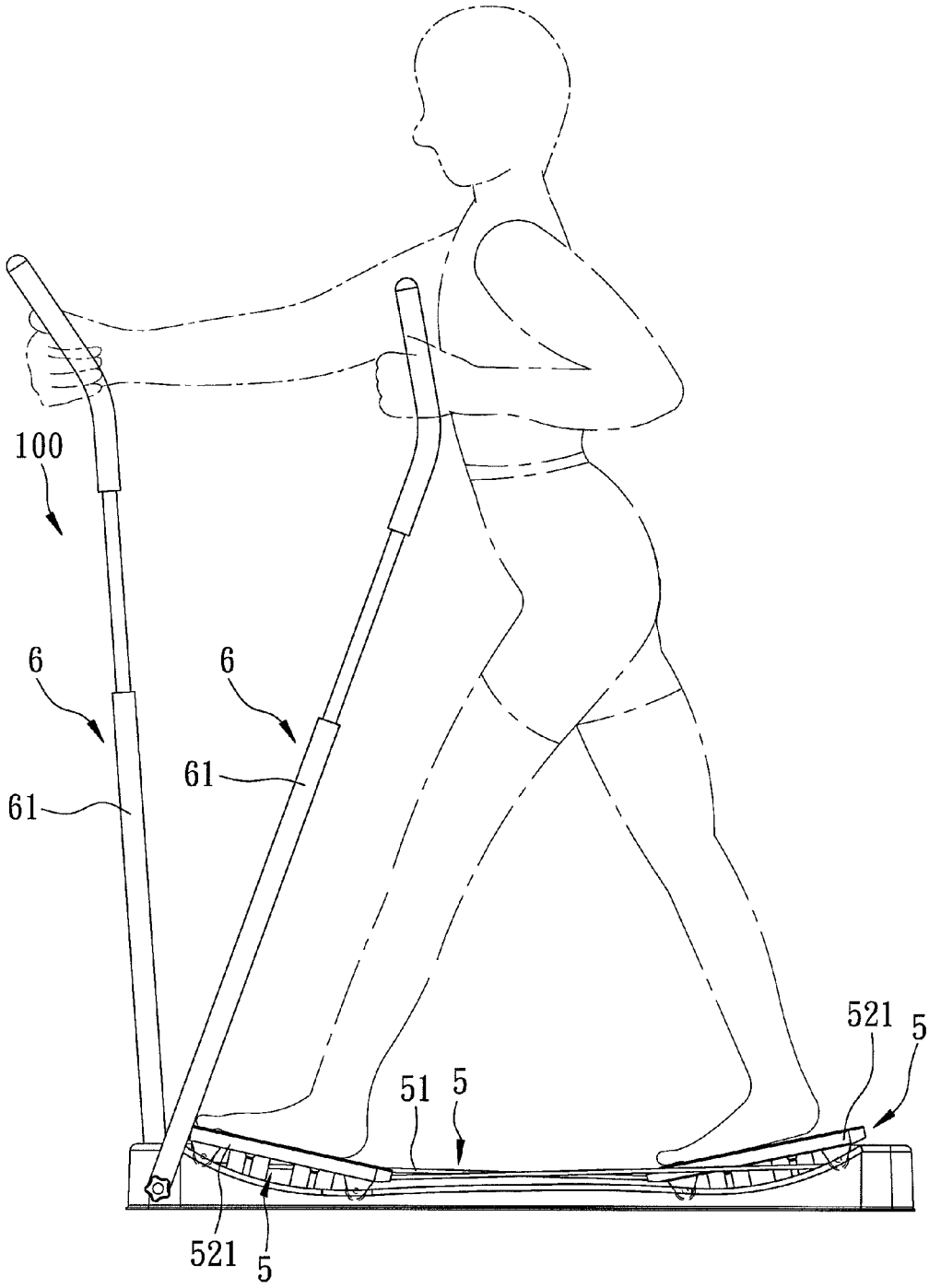
FIG. 8 is a view similar to FIG. 5, but illustrating the preferred embodiment in a state of use.

With reference to FIGS. 4 and 8, when the pedal plate 521 of a left pedal unit 5 is pedaled by the user to move toward the respective handgrip 61 along the slide rail 311 of the left ski member 31, the pedal plate 521 of a right pedal unit 5 is pulled by the rear pull rope 512 to move away from the respective handgrip 61 along the slide rail 311 of the right ski member 31. The user exercises by pedaling the pedal plates 521 back and forth along the wavy slide rails 311 of the respective ski members 31.

Figure 9:
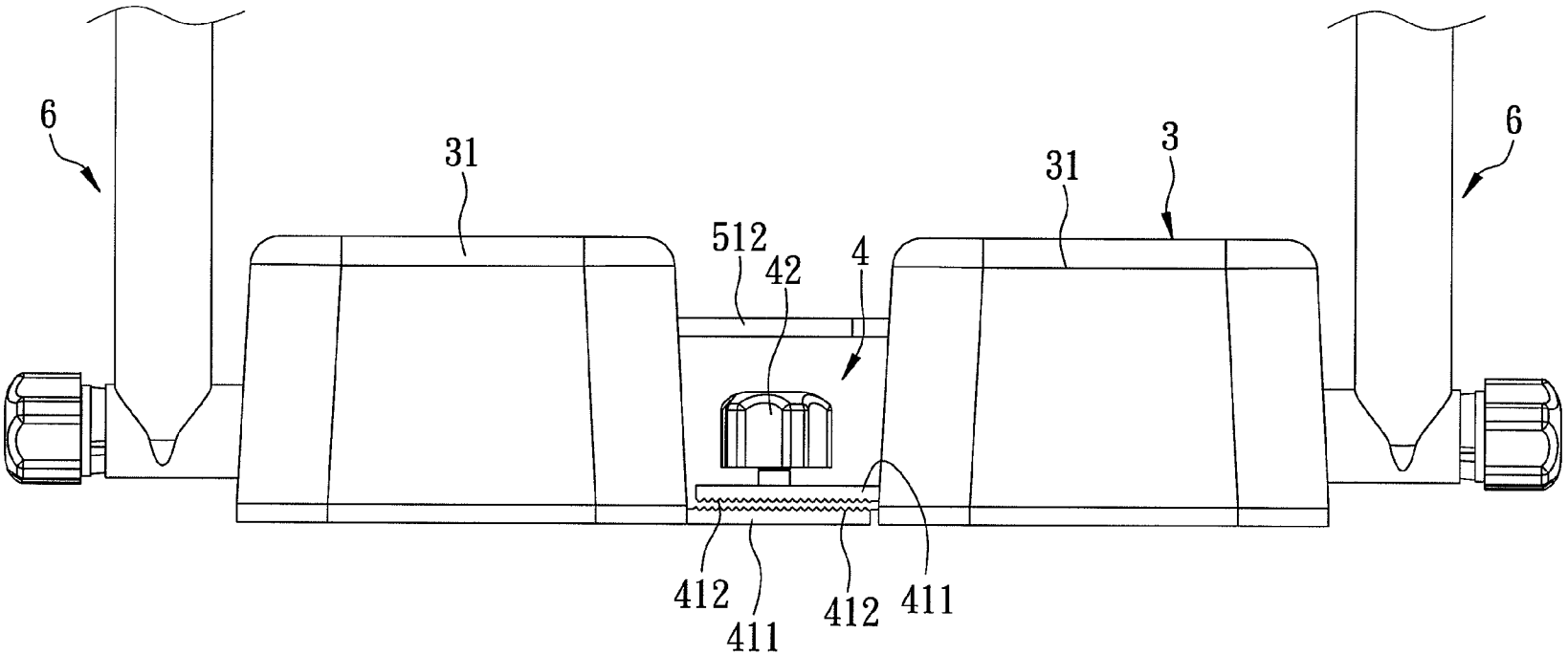
FIG. 9 is an enlarged fragmentary schematic front view of the preferred embodiment, illustrating a positioning screw of a connection unit in a loosened state.
Figure 11:
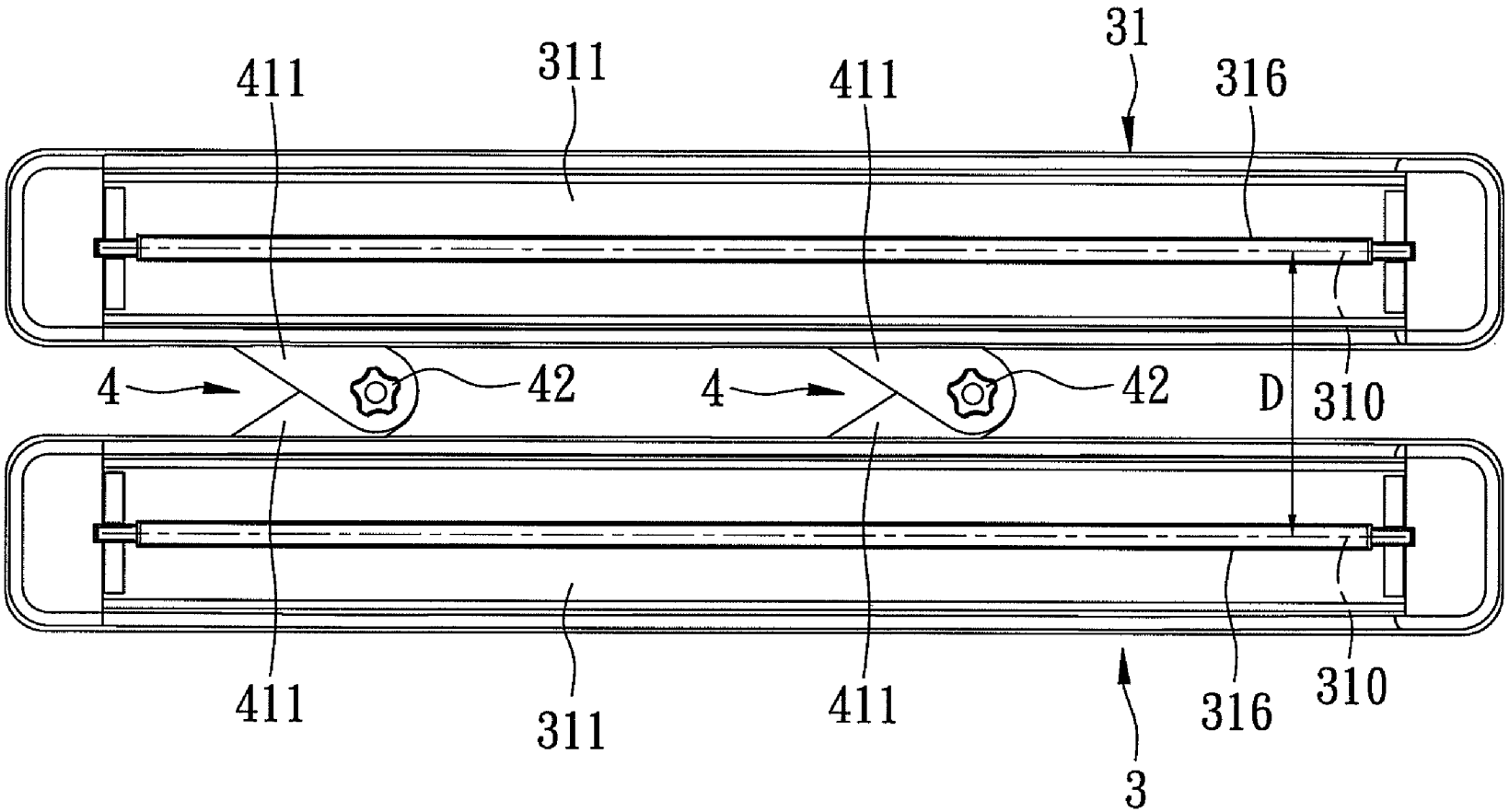
FIG. 11 is a schematic top view of two ski members of the preferred embodiment.
Figure 12:
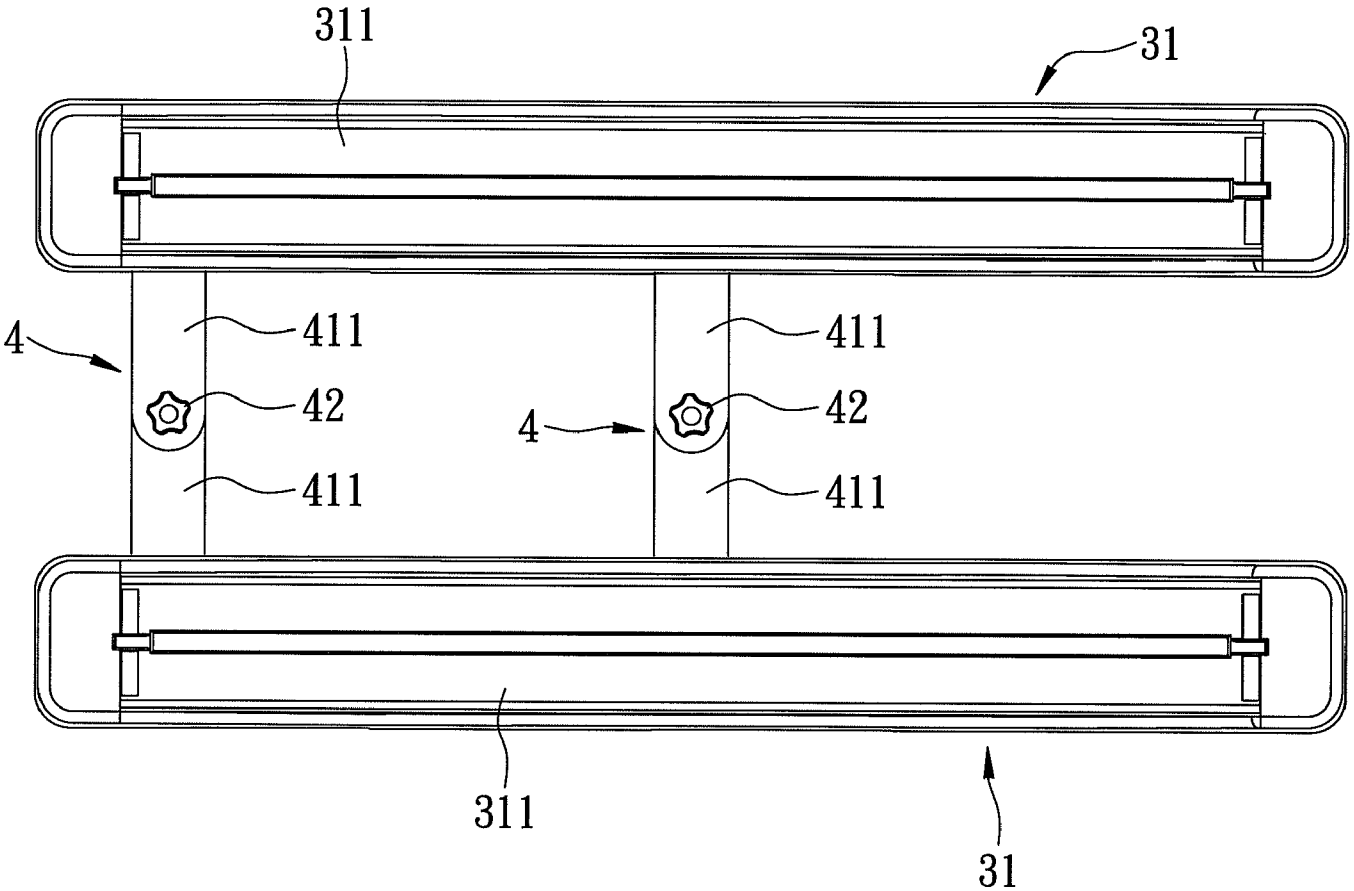
FIG. 12 is a view similar to FIG. 11, but illustrating the ski members disposed farther from each other.
Figure 13:
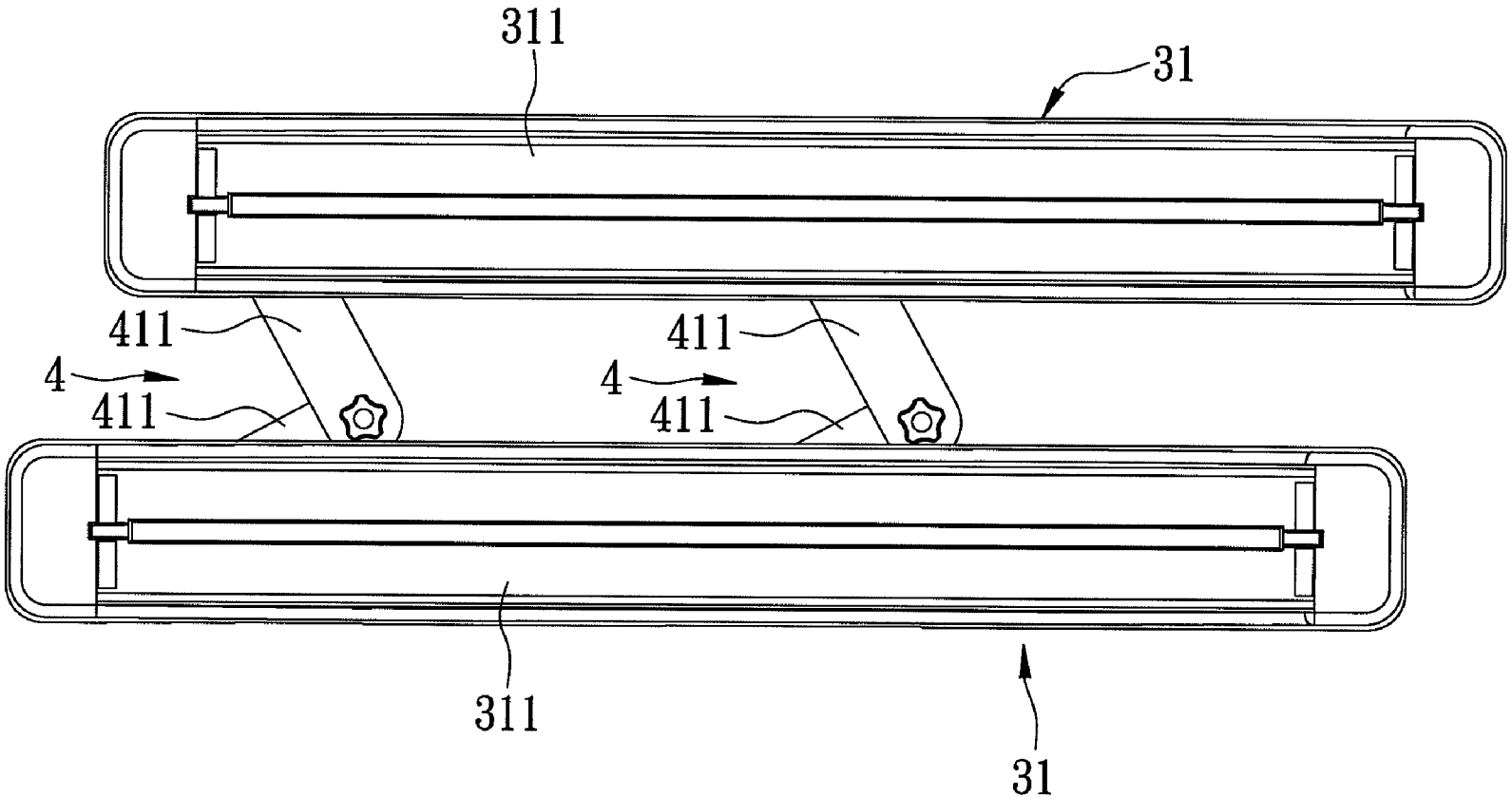
FIG. 13 is a view similar to FIG. 11, but illustrating one of the ski members disposed ahead of the other ski member.
Figure 14:
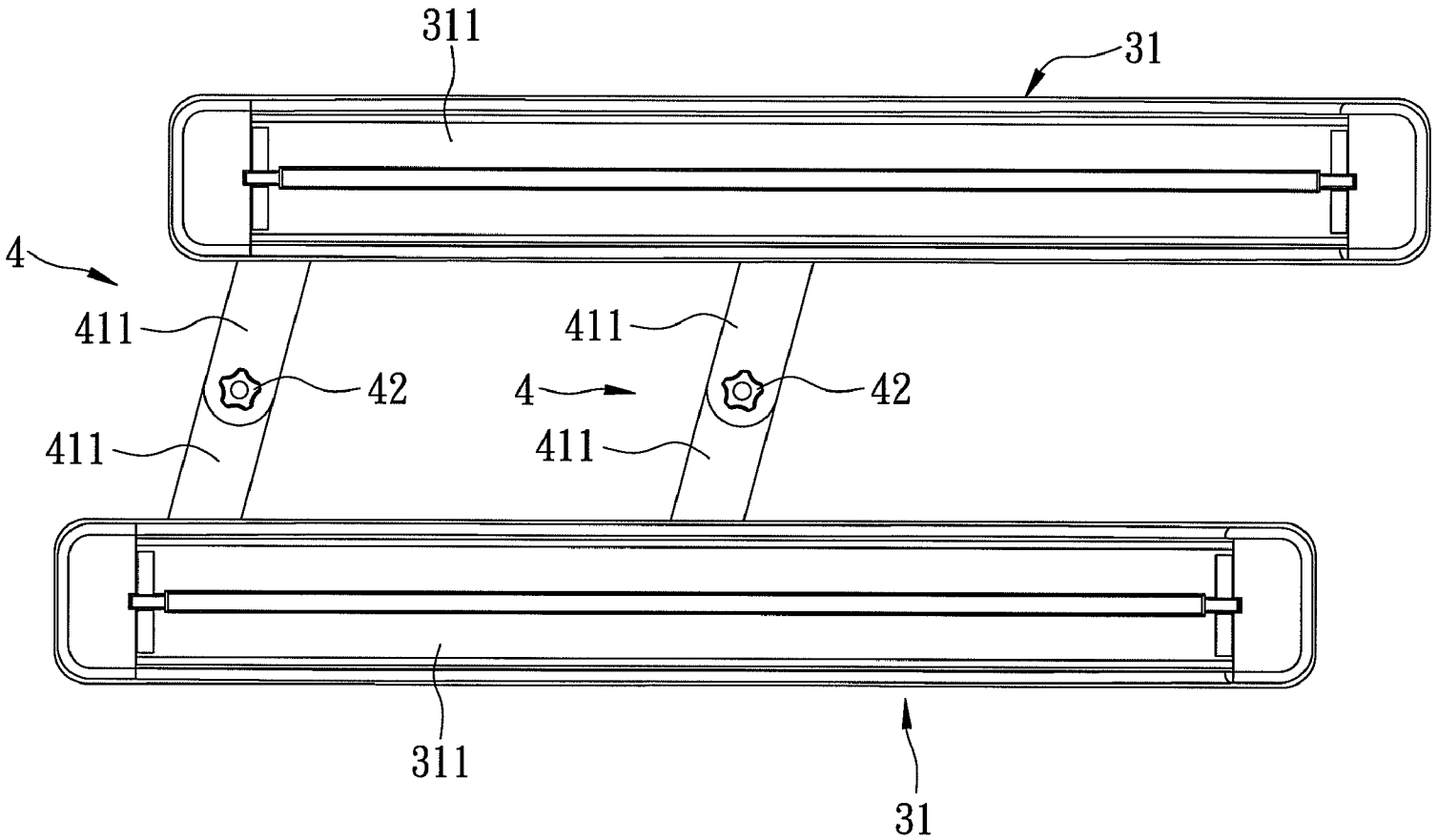
FIG. 14 is a view similar to FIG. 13, but illustrating the ski members disposed farther from each other.
Figure 15:
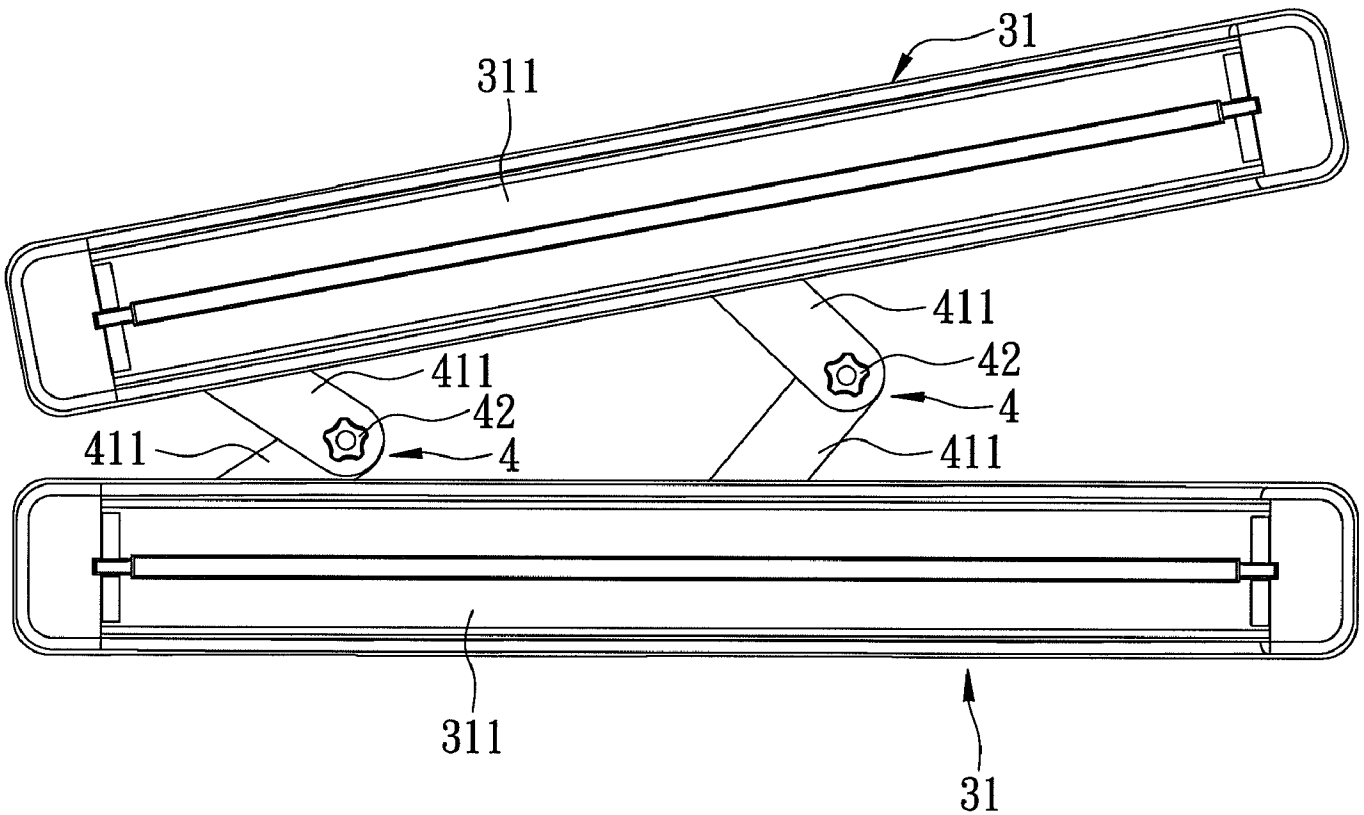
FIG. 15 is a view similar to FIG. 11, but illustrating a right one of the ski members being moved inclinedly with respect to a left one of the ski members.
Figure 16:
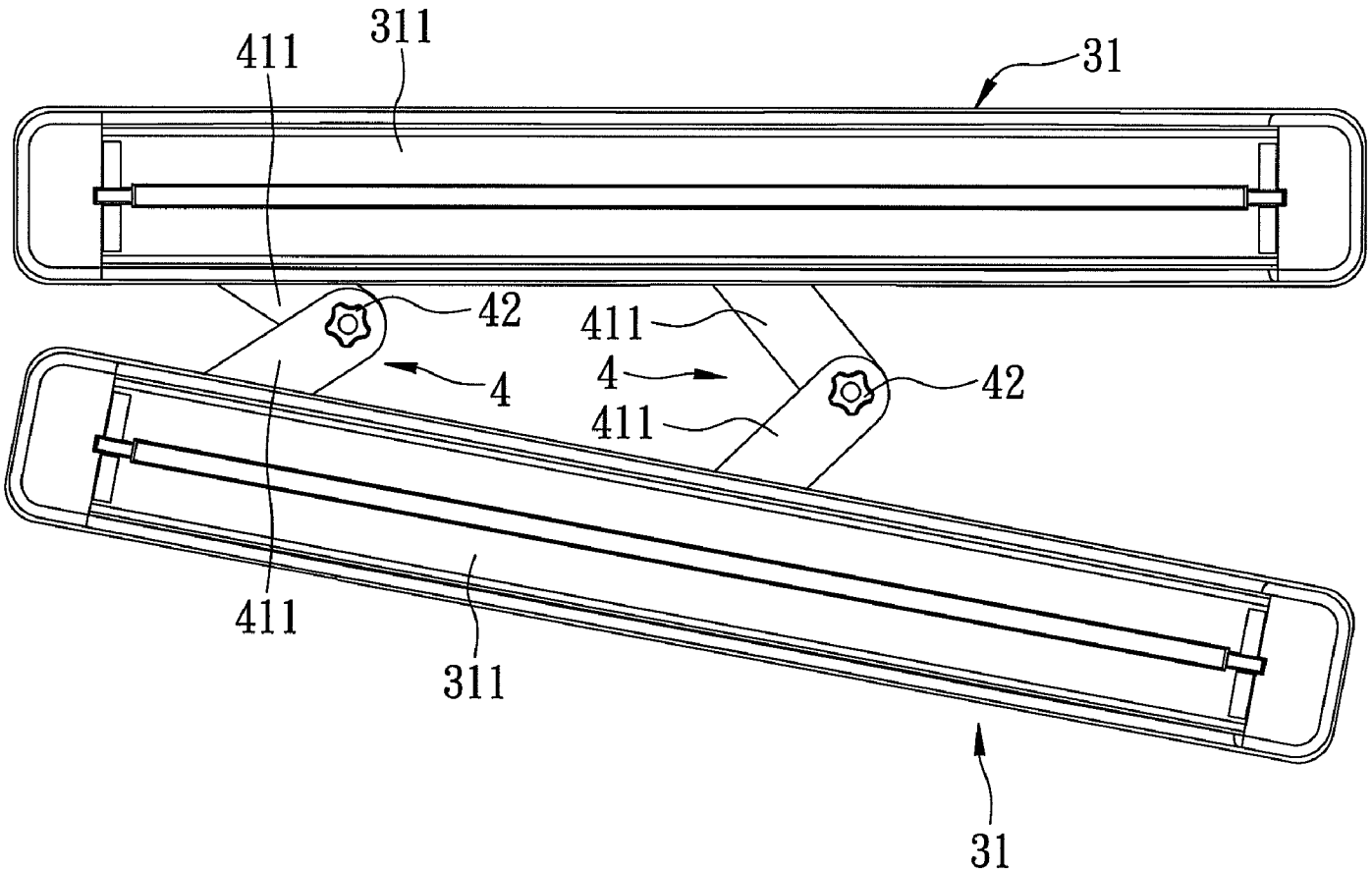
FIG. 16 is a view similar to FIG. 11, but illustrating the left one of the ski members being moved inclinedly with respect to the right one of the ski members.
Figure 17:
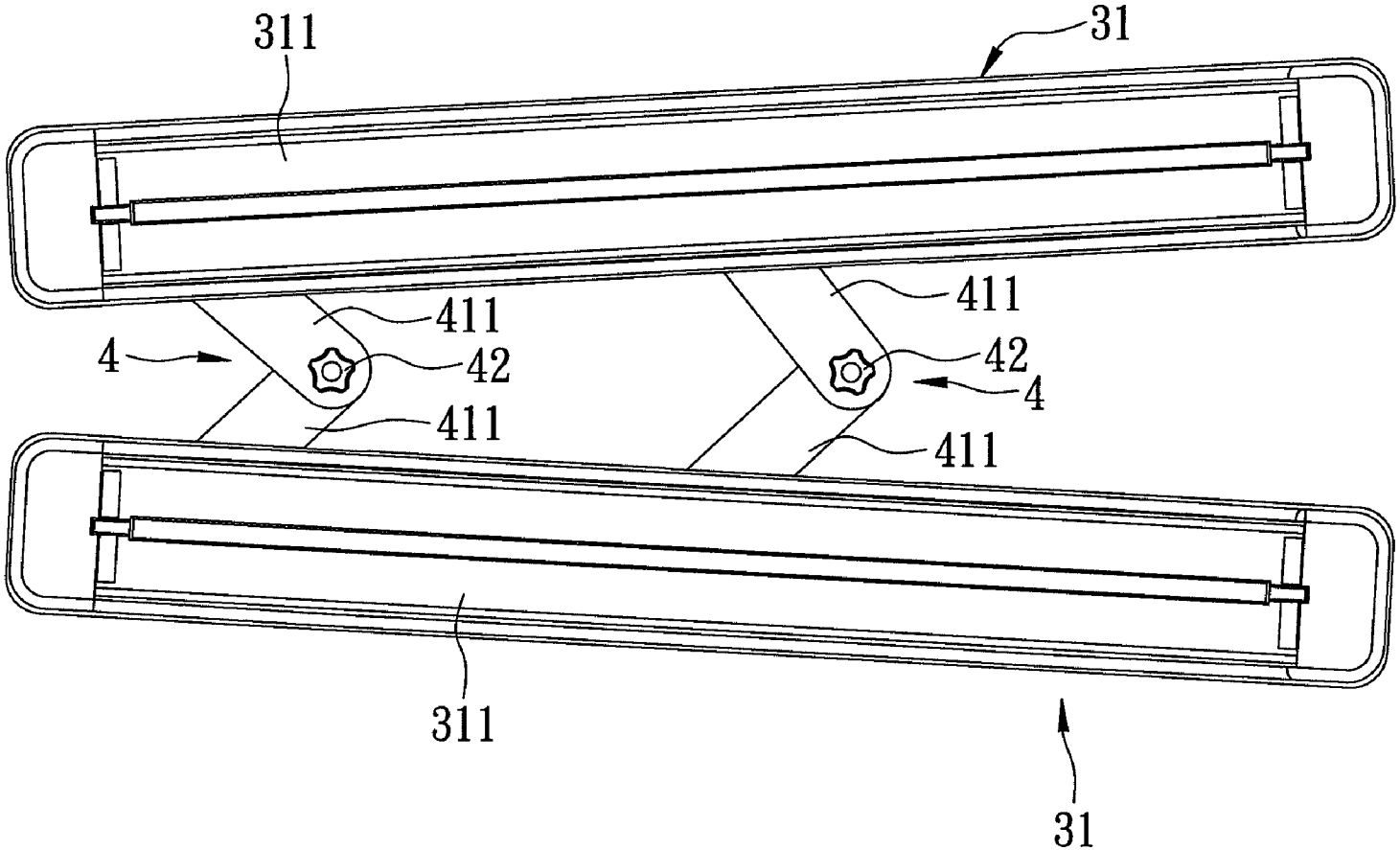
FIG. 17 is a view similar to FIG. 11, but illustrating rear ends of the left and right ski members being moved away from each other.

With reference to FIG. 9, when the positioning screw 42 is loosened, the radial teeth 412 of the pivot plates 411 can be moved away from each other, so that the user can change the position and orientation of the pivot plates 411 and the ski members 31 according to his/her exercising requirements. The user can adjust the ski members 31 to a position that is parallel to each other, as shown in FIG. 11, or that is parallel but farther apart from each other, as shown in FIG. 12. The user may also move one of the ski members 31 ahead of the other ski member 31, as shown in FIG. 13, or the same as FIG. 13 but with the ski members 31 farther apart from each other, as shown in FIG. 14. Further, the user may also move the right ski member 31 inclinedly with respect to the left ski member 31, as shown in FIG. 15, or move the left ski member 31 inclinedly with respect to the right ski member 31, as shown in FIG. 16. Moreover, the user may move the rear ends of the left and right ski members 31 away from each other, as shown in FIG. 17, or may make various other adjustments of one of the ski members 31 relative to the other ski member 31.

With reference to FIG. 10, when the positioning screw 42 is tightened, the radial teeth 412 of the pivot plates 411 are interlocked with each other, so that relative movement of the pivot plates 411 can be prevented.

Hence, the user is able to achieve a variation of combinations to form different kinds of slide paths to suit his/her requirements. Therefore, different kinds of challenges and training are possible.

With reference to FIGS. 7, 18, and 19, when the first end 5261 of the push member 526 is pushed toward the reel casing 520, the inclined surfaces 5053, 5054 of the first and second push protrusions 5051, 5052 push the ring portion 501 away from the push member 526 so that the external gear teeth portion 5011 is moved downwardly and disengages from the internal gear teeth portion 528. At this time, the abutment portion 502 compresses the spring element 524, and the knob 504 is operable to rotate the spool shaft 503 relative to the spindle 527, so that the pull rope 511, 512 (see FIG. 4) can be reeled into or unreeled from the spool shaft 503 to thereby adjust the pull rope 511, 512 to a desired length. When the second end 5261' of the push member 526 is pushed toward the reel casing 520, the inclined surfaces 5053, 5054 of the first and second push protrusions 5051, 5052 are pushed away from the ring portion 501, so that the ring portion 501 can return to its original position shown in FIG. 19 through a restoring force of the spring element 524. Further, the external gear teeth portion 5011 can be re-engaged with the internal gear teeth portion 528. In this state, the knob 504 is not operable, and the length of the pull rope 511, 512 is fixed.

From the aforesaid description, the ski exercising apparatus 100 of the present invention has the following effects:

1. Since the slide rails 311 of the ski members 31 have wavy configurations, and since the user can adjust the pivot plates 411 and the ski members 311 to different positions and orientations so as to form different kinds of slide paths, the slide paths can simulate the uneven roads or paths found in natural settings. Hence, apart from the exercises that can be performed, training of the balance and reaction of the user can also be achieved. By mastering the different roads or paths formed from the different combinations of the ski members 31 and the pivot plates 411, user interest in exercising can be increased.

2. Since the front and rear end sections 313, 313' of the slide rails 311 of the ski members 31 are high, during the reciprocal movement of the user's feet along the slide rails 311 of the ski members 31, when the toes of one of the user's feet are raised upwardly, the toes of the user's other foot are lowered. These actions conform to ergonomics. Hence, the risk of injury (e.g., to the user's ankles) can be minimized, and user comfort during exercise can be enhanced.

3. The pedal plates 521 of the pedal units 5 can slide stably on the slide rails 311 of the respective ski members 31 through the presence of the rollers 522, so that the user's feet can stably pedal the pedal plates 521, thereby enhancing safety during exercise.

It should be noted that, as long as the slide rail 311 is wavy, there may be two or more of the raised sections 314 of the slide rail 311 of each ski member 31, and there may be three or more of the concave sections 315.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A ski exercising apparatus comprising:

a ski unit including two ski members each having a wavy slide rail extending in a front-to-rear direction;

two pedal units mounted slidably and respectively on said slide rails of said ski members;

at least one pull rope mounted movably to said ski members and having two opposite ends connected respectively to said pedal units;

two handle units connected pivotally and respectively to said ski members; and at least one connection unit disposed between and interconnecting said ski members and adjustable to change the position and orientation of one of said ski members relative to that of the other one of said ski members;

wherein each of said pedal units includes a pedal plate, a plurality of rollers mounted rotatably to a bottom side of said pedal plate, and at least one reel assembly connected to said bottom side of said pedal plate to reel and unreel said pull rope.

2. The ski exercising apparatus of claim 1, wherein said connection unit includes two pivot plates and a positioning screw, each of said pivot plates having one end connected pivotally to one of said ski members, the other ends of said pivot plates being fastened releasably to each other through said positioning screw.

3. The ski exercising apparatus of claim 2, wherein said other ends of said pivot plates are disposed one over the other, and are each provided with angularly spaced-apart radial teeth, said positioning screw being operable to loosen and tighten said pivot plates, said radial teeth of said pivot plates interlocking with each other when said positioning screw is tightened.

4. The ski exercising apparatus of claim 1, wherein said slide rail includes a wavy top surface of a respective said ski member, said pedal units being respectively slidable on said wavy top surfaces of said ski members, said wavy top surface of each of said ski members having front and rear end sections, a raised section between said front and rear end sections, and concave sections each disposed between one of said front and rear end sections and said raised section, said raised section having a height lower than that of said front and rear end sections.

5. The ski exercising apparatus of claim 4, wherein a maximum height of each of said front and rear end sections measured from a lowest point of each of said concave sections ranges between 2 and 10 inches.

6. The ski exercising apparatus of claim 5, wherein said wavy top surface of each of said ski members further has a wavy guide ridge protruding therefrom, said wavy guide ridge extending in the front-to-rear direction and having a central line extending along the length thereof, a distance between said central lines of said wavy guide ridges of said ski members ranging between 6 and 24 inches.

7. The ski exercising apparatus of claim 1, wherein said reel assembly includes a reel casing disposed beneath and connected to said bottom side of said pedal plate and having an inner surface provided with an internal gear teeth portion, a spindle projecting downwardly from said bottom side of said pedal plate within said reel casing, a reel member sleeved rotatably on said spindle, and a push member disposed transversely in said reel casing between said pedal plate and said reel member and having first and second opposite ends extending outwardly of said reel casing, said reel member including a spool shaft, an annularly arranged external gear teeth portion disposed on a top end of said spool shaft and engageable with said internal gear teeth portion, and a knob disposed at a bottom end of said spool shaft and operable to rotate said spool shaft so that said pull rope can be reeled or unreeled around or from said spool shaft, said push member being operable to move transversely of said spindle so that said push member pushes said reel member downwardly to disengage said external gear teeth portion from said internal gear teeth portion.

8. The ski exercising apparatus of claim 7, wherein said reel member further includes an annular abutment portion formed on said top end of said spool shaft, an annular flange portion extending radially and outwardly from said annular abutment portion, and a ring portion extending upwardly from an outer periphery of said annular flange portion, said ring portion having an outer surface formed with said external gear teeth portion, and an inner conical surface extending upwardly and divergingly from said annular abutment portion, said push member being sleeved movably on said spindle and including a first push protrusion between said first and second ends of said push member and extending downwardly into said inner conical surface, and a second push protrusion disposed in proximity to said first end of said push member, wherein when said first end of said push member is pushed toward said reel casing, said first and second push protrusions push said external gear teeth portion so that said external gear teeth portion is moved downwardly and disengages from said internal gear teeth portion.

9. The ski exercising apparatus of claim 8, wherein said spool shaft has an annular space around said spindle and proximate to said knob, said reel member further including a spring element sleeved on said spindle within said annular space and biasing said reel member toward said push member.

10. The ski exercising apparatus of claim 7, wherein said reel member further includes a retaining element retaining said reel member on said spindle.

* * * * *